United States Patent [19]

Ohno

[11] Patent Number: 4,578,046

[45] Date of Patent: Mar. 25, 1986

[54] REVERSIBLY TRANSFORMABLE TOY BLOCK ASSEMBLY

[75] Inventor: Kouzin Ohno, Tokyo, Japan

[73] Assignee: Takara Co., Ltd., Tokyo, Japan

[21] Appl. No.: 476,822

[22] Filed: Mar. 18, 1983

[30] Foreign Application Priority Data

Mar. 24, 1982 [JP] Japan ..... 57-41463[U]

[51] Int. Cl.[4] ..... A63H 3/46; A63H 17/00

[52] U.S. Cl. ..... 446/376; 446/465; 446/487

[58] Field of Search ..... 446/95, 94, 93, 96, 446/97, 99, 269, 268, 320, 321, 376, 431, 465, 470, 487

[56] References Cited

U.S. PATENT DOCUMENTS 4,051,623 10/1977 Ogawa .
4,095,367 6/1978 Ogawa .
4,170,840 10/1979 Ogawa .
4,206,564 6/1980 Ogawa .
4,391,060 7/1983 Nakane ..... 446/94

FOREIGN PATENT DOCUMENTS 55-1662 1/1980 Japan .
57-5032 1/1982 Japan .
57-60694 4/1982 Japan .
2060414 5/1981 United Kingdom .

*Primary Examiner*—Mickey Yu
*Attorney, Agent, or Firm*—Price, Gess & Ubell

[57] ABSTRACT

A reversibly transformable toy block assembly is disclosed which is constructed in such a manner to be reversibly transformed between two kinds of toys entirely different from each other. Typically, the toy block assembly may be assembled or constructed in a manner to be reversibly transformed between a toy vehicle formed by folding the block assembly and a toy robot formed by unfolding the block assembly.

12 Claims, 14 Drawing Figures

REVERSIBLY TRANSFORMABLE TOY BLOCK ASSEMBLY

BACKGROUND OF THE INVENTION

1. Field of the Invention

This invention relates to a reversibly transformably toy block assembly, and more particularly to a toy block assembly which is constructed in such a manner to be reversibly transformed between two kinds of toys entirely different in appearance and the like from each other.

2. Description of the Prior Art

There has appeared on the market various kinds of toys for children such as a toy vehicle, a toy robot, a flying toy and the like. Such conventional toys are generally classified into a static toy group consisting of a toy robot and the like and a dynamic toy group consisting of a toy vehicle, a flying toy and the like. The toys of the former group are generally constructed to allow children to take pleasure in their appearance and configuration; whereas the latter toys are adapted to arouse children's interest in their motion and function. Accordingly, it will be noted that the former toys and the latter ones have interests different in nature from each other for children. This would be one of the reasons why children want toys of such two kinds. Thus, it is believed that the appearance of a toy on the market which has two reversibly transformable configurations entirely different from each other, for example, such as a robot and vehicle will permit children's interest to be redoubled. Further, such reversibly transformable toy will be rich in unexpectedness and originality.

BRIEF SUMMARY OF THE INVENTION

The present invention has been made in view of the foregoing.

Accordingly, it is the primary object of the present invention to provide a novel reversibly transformable toy block assembly which can be reversibly transformed to provide two kinds of toys entirely different in nature from each other.

It is another object of the present invention to provide a reversibly transformable toy block assembly which can be reversibly transformed between a static toy and a dynamic toy.

It is a further object of the present invention to provide a reversibly transformable toy block assembly which is capable of forming a toy having two reversibly transformable appearances different from each other.

It is still a further object of the present invention to provide a reversibly transformable toy block assembly which can be transformed to alternately provide a toy vehicle and a toy robot as desired.

In accordance with the present invention, there is provided a reversibly transformable toy block assembly comprising a frame means; a pair of first movable elements mounted on both sides of the frame means so as to be shiftable between a first position and a second position; a second movable element mounted on the frame means so as to be shiftable between a third position and a fourth position; a third movable element slidably attached to the frame means so as to be slidable between a fifth position and a sixth position; and a fourth movable element attached to the end portion of the third movable element so as to be shiftable between a seventh position and an eighth position; wherein the toy block assembly forms a first toy when the first, second, third and fourth movable elements are respectively in the first, third, fifth and seventh positions and the toy block assembly forms a second toy different in appearance from the first toy when the first to fourth movable elements are respectively in the second, fourth, sixth and eighth positions.

In a preferred embodiment of the present invention, the first and second toys may be embodied as a toy vehicle and a toy robot which have such configurations as resembling a vehicle and a robot, respectively. The block assembly of such embodiment is constructed in such a manner that when the block assembly is transformed into the toy robot, the frame means forms a trunk of the toy robot and the first to fourth movable elements respectively form arms, a head, legs and feet of the toy robot.

The invention accordingly comprises the features of construction, combination of elements and arrangement of parts which will be exemplified in the construction hereinafter set forth, and the scope of the invention is set forth in the claims appended hereto.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a reversibly transformable toy block assembly according to the present invention will be hereinafter described by way of example with reference to the accompanying drawings.

FIGS. 1 to 7 illustrate one embodiment of a reversibly transformable toy block assembly according to the present invention. The toy block assembly of the illustrated embodiment is adapted to be reversibly transformed between a toy vehicle and a toy robot. More particularly, in FIG. 1, the toy block assembly is folded to provide a toy vehicle 1; and in FIG. 7, the block assembly is transformed into an unexpected toy robot by unfolding the toy vehicle 1 of FIG. 1. The toy block assembly of the present embodiment comprises constituent elements which, as a whole, have an appearance resembling a vehicle when it is folded and an appearance resembling a robot when it is unfolded, as viewed from the outside.

The toy block assembly of the illustrated embodiment will be hereinafter described by way of the toy vehicle and the toy robot reversibly transformed therebetween which are shown in FIGS. 1 to 7.

Figure 1:
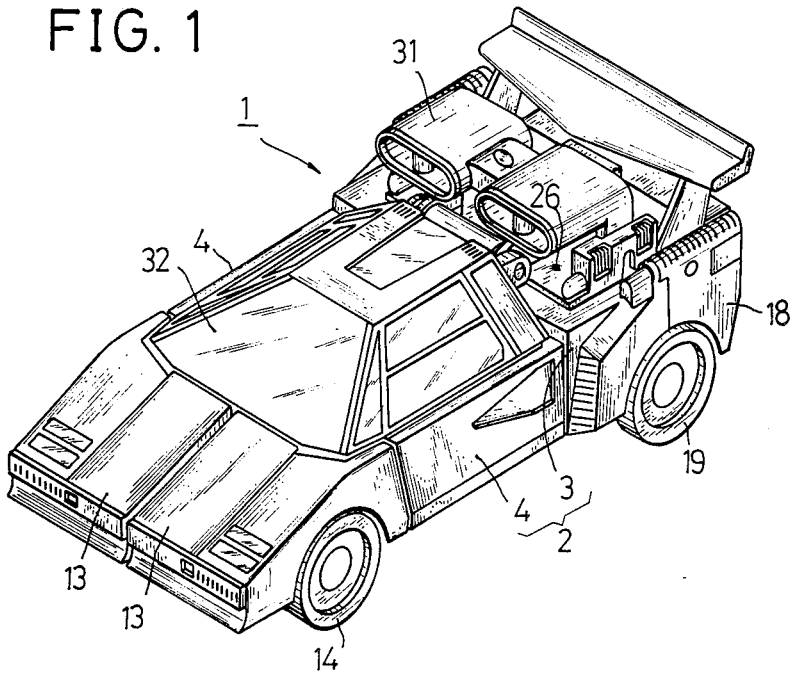
FIG. 1 is an elevational view, in perspective, illustrating one embodiment of a reversibly transformable toy block assembly according to the present invention in which the toy block assembly is folded to be transformed into a toy vehicle.
Figure 6:
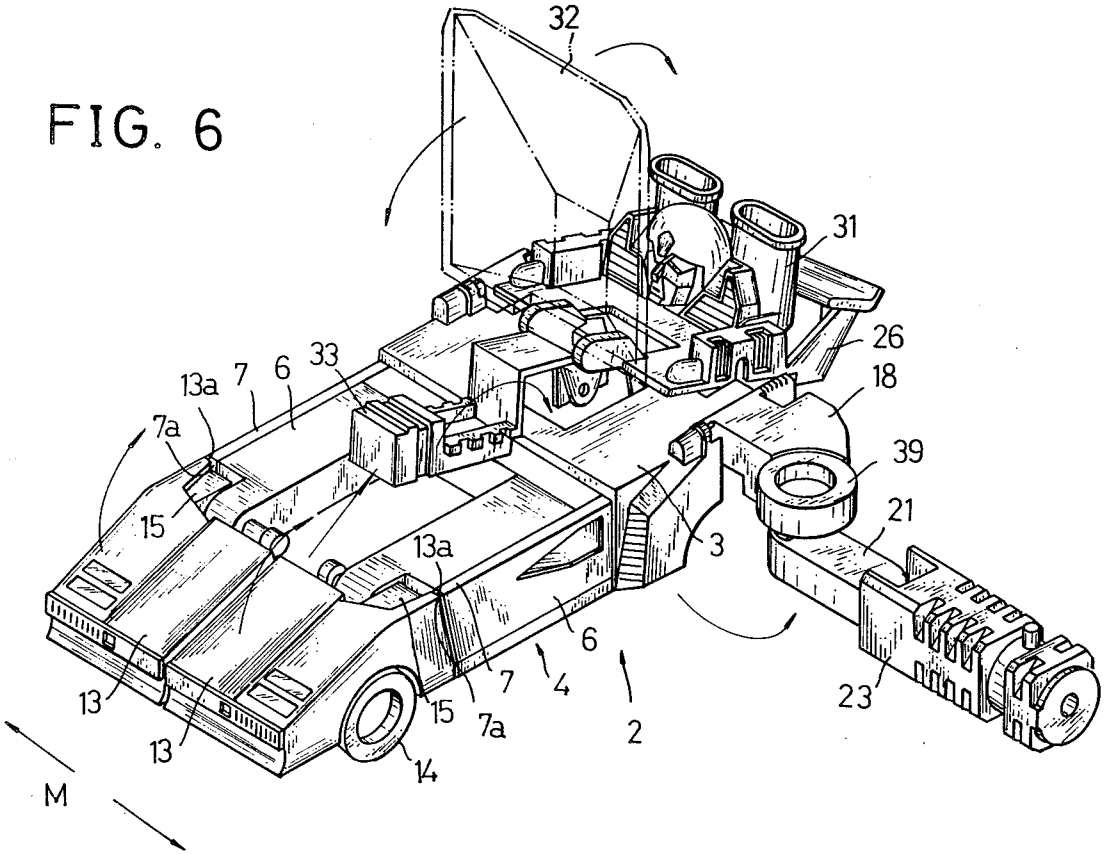
FIG. 6 is a diagrammatical perspective view showing a manner of reversibly transforming the toy block assembly shown in FIG. 1 between a toy vehicle and a toy robot.

The toy vehicle 1 shown in FIG. 1 includes a body 2, which comprises a rear body member 3 formed to resemble the rear portion of a vehicle and a pair of front body members 4 strechably connected to the front end portion of the rear body member 3. The front body 4 comprises a pair of guide rods 5 provided on the front end portion of the rear body 3 so as to forwardly extend therefrom and a pair of cylindrical members 6 rectangular in section slidably fitted on the guide rods 5. Each of the cylindrical members 6 is provided on the outer surface thereof with a rib 7 extending along the longitudinal direction thereof, as shown in FIG. 6. Either the guide rod 5 or the cylindrical member 6 is formed with a stopper (not shown) for preventing the cylindrical member 6 from being removed from the guide rod 5. Reference numeral 8 designates a supporting plate of a T-shape extending between the cylindrical members 6 and 6 and fixed at each of the both side portions thereof onto the upper surface of the front portion of each of the cylindrical members 6. The supporting plate 8, when the block assembly is transformed into the toy robot, acts to keep the toy robot in a vertical state. Each of the cylindrical members 6 is also provided at the end portion thereof with a bearing means 9, which is formed with a through-hole 10 extending in the lateral direction of the cylindrical member 6. Into the throughhole 10, a pin member 11 is inserted in such a manner to be rotatable and longitudinally slidable in the throughhole 9. Each of the pin members 11 is formed at the inner end portion thereof with a stopper 12 which serves to prevent the pin member 11 from being removed from the through-hole 9. Also, each of the pin members 11 has a front wheel supporting member 13 attached to the outer end thereof so that the member 13 may be swung about the pin member 11 and slidably moved in the longitudinal direction of the pin member 11. The front wheel supporting members 13 each have a front wheel 14 rotatably mounted on the outer side thereof. Also, each of the front wheel supporting members 13, as shown in FIG. 6, is formed at the upper surface of the rear portion thereof with a depression 15. The front wheel supporting members 13 are constructed in a manner such that when the members 13 are positioned in proximity to each other as shown in FIG. 6, the rear end surface 13*a* of each of the supporting members 13 is positioned close to the front end surface 7*a* of the rib 7 provided on the upper portion of the outer surface of each of cylindrical member 6, to thereby prevent rotation of the front wheel supporting member 13. Whereas, when the front wheel supporting members 13 are slidably moved in the lateral directions opposite to each other as indicated by arrows M in FIG. 6, the rear end of each of the depressions 15 becomes close to the front end surface 7*a* of the corresponding rib 7 to allow the front wheel supporting member 13 to be swung in the clockwise direction in FIG. 6. In this instance, when the supporting member 13 is moved by an angle of 90 degree, the rib 7 is abutted at the front end 7*a* thereof against the upper surface of the depression 15 to prevent a further rotation of the member 13.

Figure 3:
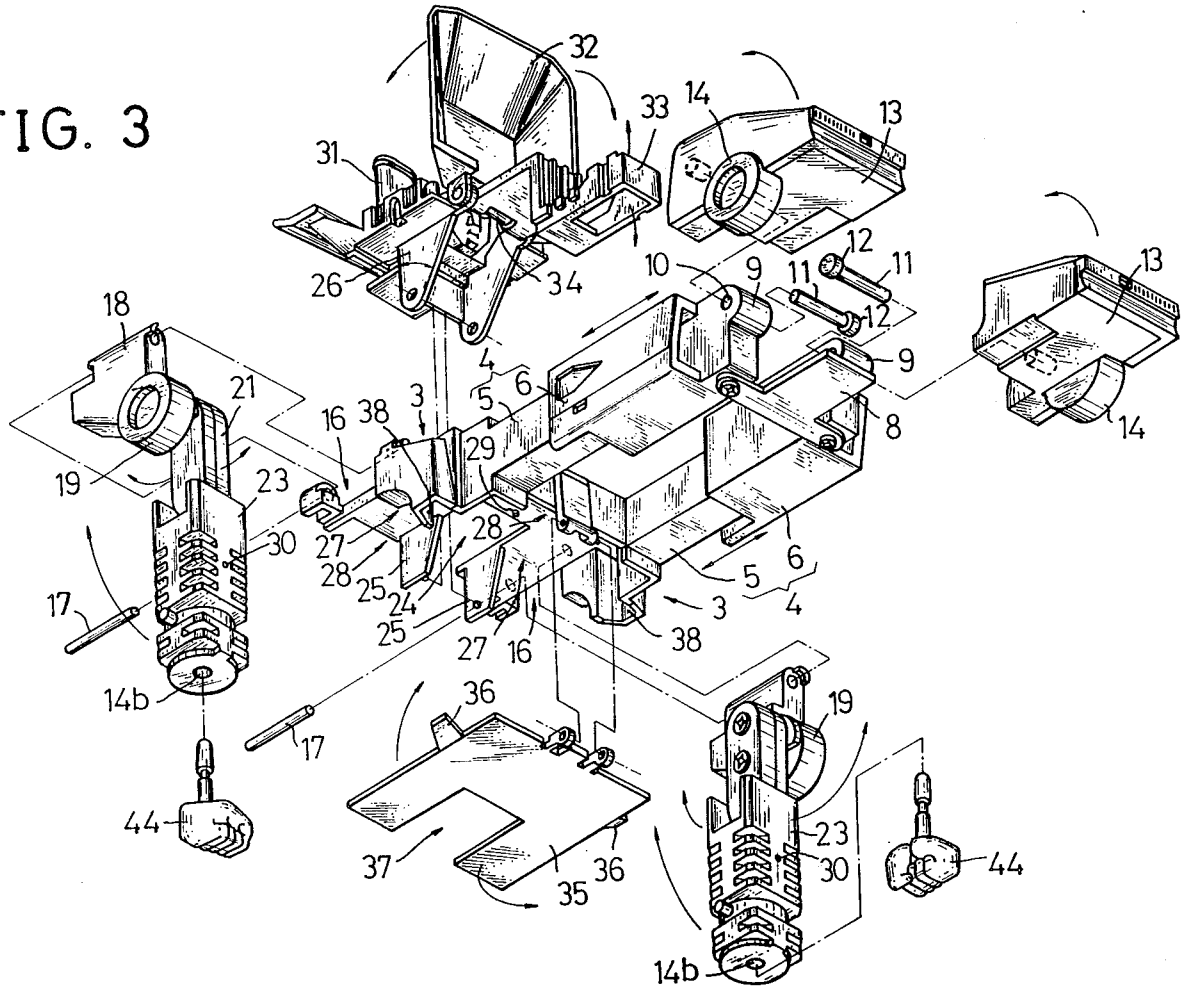
FIG. 3 is an exploded perspective view of the toy vehicle shown in FIG. 1 in which constituent elements of the toy block assembly are shown in detail.
Figure 4:
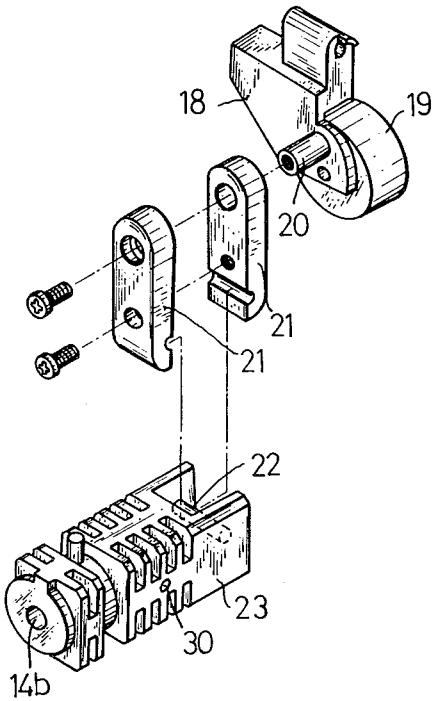
FIG. 4 is an exploded perspective view showing elements forming the arm portion of a toy robot formed by unfolding the toy vehicle shown in FIG. 1.

The rear body 3 is formed on the both sides thereof with U-shaped cutouts 16, as shown in FIG. 3. The leg portions of each of the cutouts 16 are formed with through-holes for loosely fitting the end portions of a pin 17 therein which extends therebetween. Each of the pins 17 has a rear wheel supporting member 18 fitted thereon in such a manner that the member 18 is swingably suspended therefrom. Also, the rear wheel supporting member 18, as shown in FIG. 4, is provided on the inner side of the lower portion thereof with an inwardly projecting support pin 20 in parallel with the axis of the rear wheel 19. On the support pin 20, a pair of first arm members 21 are swingably fitted at one end thereof in a manner to be close to each other. The arm members 21 are formed at the lower end thereof with recesses extending in the direction perpendicular to the pin 20 and opposite to each other to form a through-hole together. In each of the so-formed through-holes, a pin 22 of a second arm member 23 is rotatably fitted to allow the arm member 23 to be swung with respect to the rear wheel supporting member 18.

The rear body 3, as shown in FIG. 3, is also provided at the rear end portion thereof with a U-shaped cutout 24, on the both sides of which a pair of vertical supporting members 25 are mounted to extend downwardly therefrom. Between the supporting members 25, a swinging member 26 is downwardly inserted at the lower portion thereof. The member 26 is swingably connected at the lower portion thereof to the supporting members 25 by loosely fitting a projection formed on the inner surface of each of the members 25 in an opening correspondingly formed at the member 26 to allow the member 26 to be swung in the longitudinal direction of the body 2. Each of the supporting members 25 is also formed at the lateral side portion thereof with a recess 27 for receiving the first arm members 26 folded. Also, recesses 28 for receiving the second arm members 23 folded are formed at the upper and lower side portions of the supporting members 25.

Thus, it will be noted that when the toy block assembly of the present invention is folded to form the toy robot, the first and second arm members 21 and 23 are received in the recesses 27 and 28, respectively. In this instance, one of the second arm members 23 is received in any one of the recesses 28 and the other second arm member is received in the remaining recess 28. Further, the upper recess 28 is provided at the substantially central portion thereof with a small projection 29 which is adapted to be fitted in a hole 30 formed on one surface of the second arm member 23 to allow the arm member 23 to be securely received in the recess.

Figure 5:
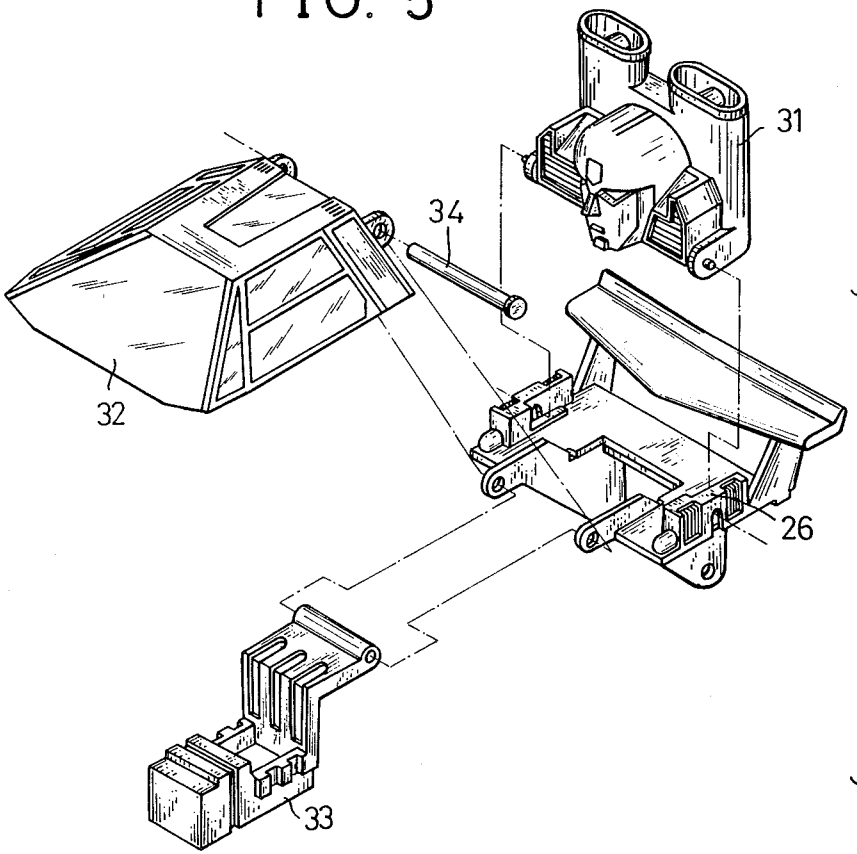
FIG. 5 is an exploded perspective view showing elements forming the head and trunk portions of a toy robot formed by unfolding the toy vehicle shown in FIG. 1.

The swinging member 26, as shown in FIG. 5, has a second swinging member 31 attached to the upper central portion thereof so that the member 31 may be swung about its axis along the lateral direction of the body 2. The member 31 has a face formed thereon which resembles that of a robot so that the face may be viewed from the outside when the swinging member 31 is swung in the counterclockwise direction in FIG. 3 to rise. Also, on the front end of the swinging member 26, a roof member 32 and a seat member 33 are swingably mounted by means of a pin member 34. The roof member 32 and seat member 33 are formed in shapes like a roof and a seat of a vehicle, respectively, and the seat member 33 is disposed to be positioned below the roof member 32.

Figure 2:
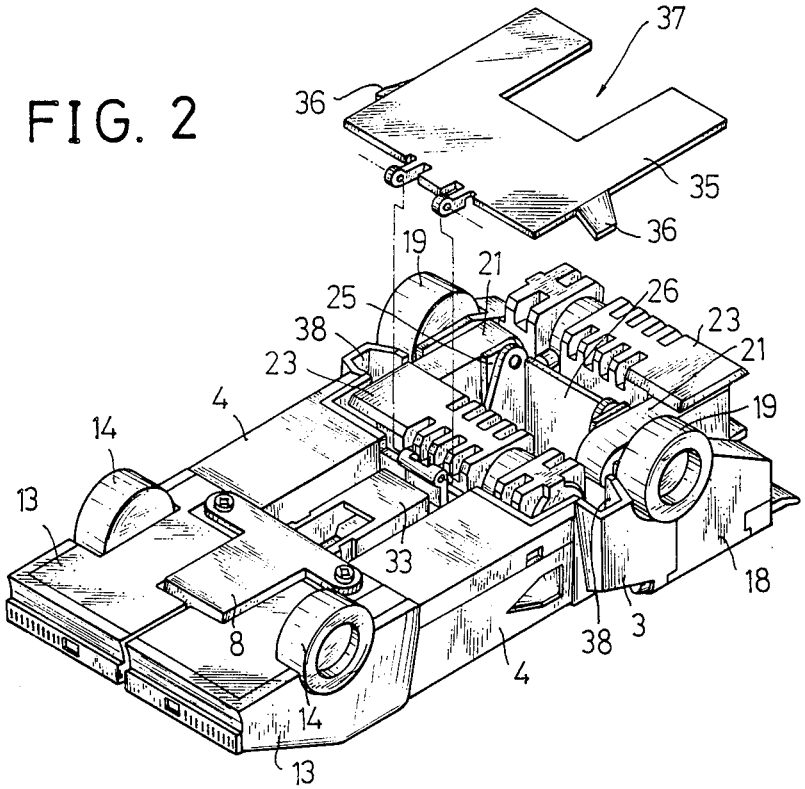
FIG. 2 is a partially exploded bottom view, in perspective, of the toy vehicle shown in FIG. 1.

The body 2, as shown in FIG. 3, also includes a snap-in plate 35 swingably mounted on the lower side portion thereof. The snap-in plate 35 is formed on the both sides thereof with projections 36 and at the rear portion thereof with a cutout 37. The body 2 is also provided on the both sides of the lower portion thereof with a pair of recesses 38 which are adapted to fit the projections 36 of the snap-in plate 35 therein. Thus, it will be noted that when the first and second arm members 21 and 23 are received in the recesses 27 and 28 formed on the lower portion of the body 2 as shown in FIG. 2 and the snap-in plate 35 is swung to cover the folded arms and be fitted at the projections 36 in the recesses 38, the folded arms are fixedly received in the body 2. In this instance, the cutout 37 is positioned to straddle the supporting member 25.

Figure 7:
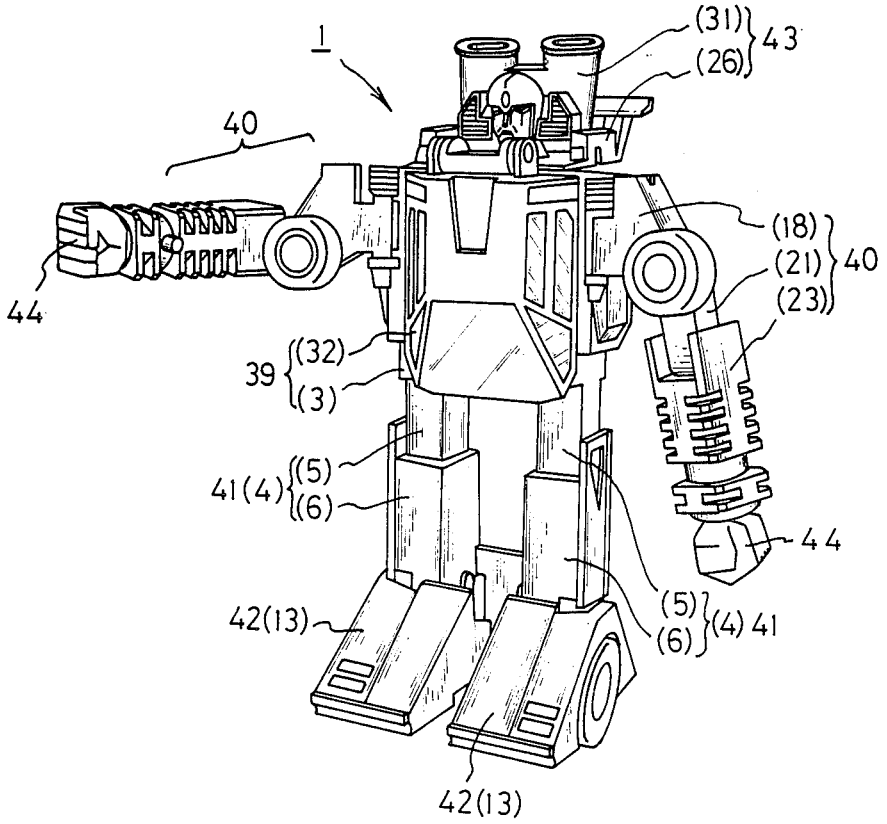
FIG. 7 is an elevational view, in perspective, of the toy block assembly of FIG. 1 transformed from a toy vehicle into a toy robot.

Now, the manner of transforming the reversibly transformable toy block assembly of the present embodiment from the toy vehicle shown in FIG. 1 into the toy robot shown in FIG. 7 will be hereinafter described in detail with reference to the drawings.

First, the swinging members 26 and 31 and roof member 32 of the toy block assembly folded as shown in FIG. 1 are swung in the clockwise direction in FIG. 6 and then the seat member 33 is swung through the U-shaped cutout 24 (FIG. 3) toward the bottom side of the body 2. Then, the front wheel supporting members 13 are outwardly moved in the lateral directions opposite to each other as indicated by the arrows M in FIG. 6 and then swung in the clockwise direction. Further, each of the rear wheel supporting members 18 is swung in the outward direction to be folded. Finally, the front body 4 is stretched, so that the toy robot shown in FIG. 7 is formed which has an appearance which is unexpected from the toy vehicle of FIG. 1.

Thus, it will be readily noted that the so-formed toy robot comprises a trunk 39 formed by the rear body 3 and the roof member 32; a pair of arms 40 formed by the rear wheel supporting members 18, the first arm members 21 and the second arm members 23; a pair of legs 41 formed by the front body 4, namely, the guide rods 5 and the cylindrical members 6; a pair of feet 42 formed by the front wheel supporting members 13; and a head 43 formed by the first and second swinging members 26 and 31.

Also, it will be readily understood that transformation of the toy block assembly from the so-formed toy robot into the toy vehicle shown in FIG. 1 can be easily accomplished by reversely practicing the above-mentioned process.

In the embodiment illustrated, each of the second arm members 23 may be formed at the front end portion thereof with a hole **14*b* which acts to snugly receive a hand 44 of the toy robot, as shown in FIG. 3**.

The reversibly transformable toy block assembly of the present embodiment constructed in such manner as described above, when transformed into the toy vehicle, allows the trunk, arms, legs, feet and head of the toy robot to be folded to form the respective portions of appearance of the toy vehicle. Thus, it will be understood that the embodiment illustrated has an excellent advantage in that the block assembly can be reversibly transformed between the toy vehicle and the toy robot with unexpectedness sufficient for children to cause interest.

FIGS. 8 to 11 illustrate another embodiment of a reversibly transformable toy block assembly according to the present invention. A toy block assembly of the present embodiment generally indicated by reference numeral 101 is also adapted to be reversibly transformed between a toy vehicle of FIG. 8 formed by folding the block assembly and a toy robot of FIG. 9 formed by unfolding it.

Figure 8:
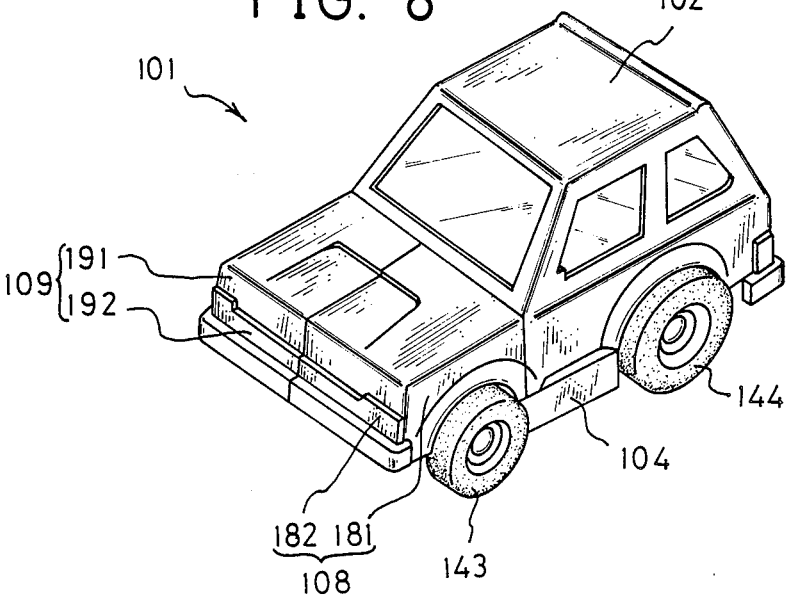
FIG. 8 is an elevational view, in perspective, illustrating another embodiment of a reversibly transformable toy block assembly according to the present invention in which the block assembly is folded to form a toy vehicle.
Figure 9:
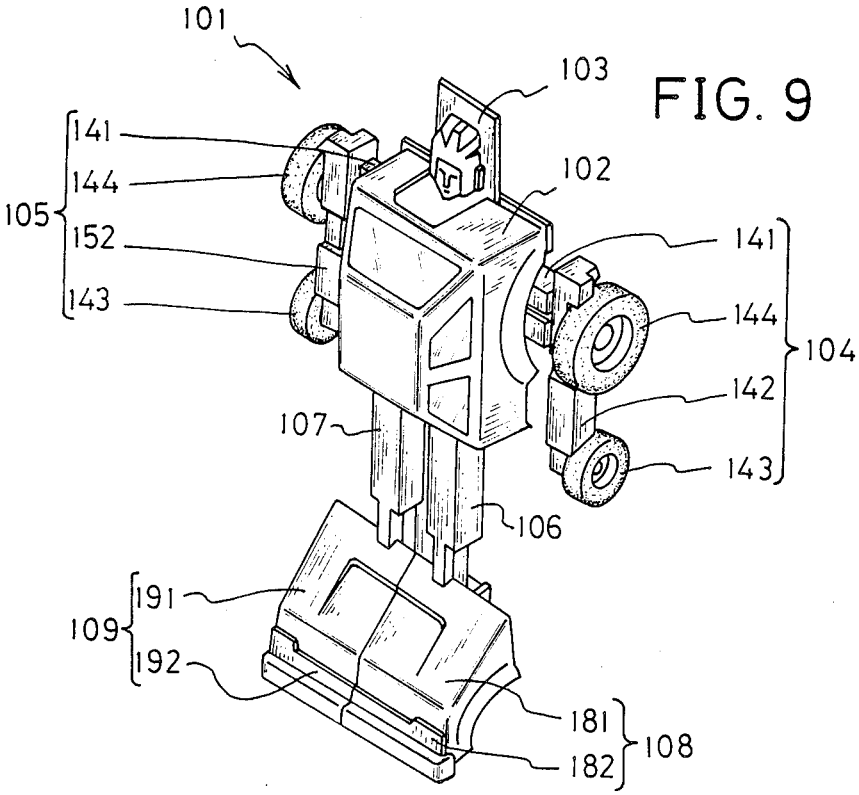
FIG. 9 is a perspective view showing a toy robot formed by unfolding the toy vehicle of FIG. 8.
Figure 10:
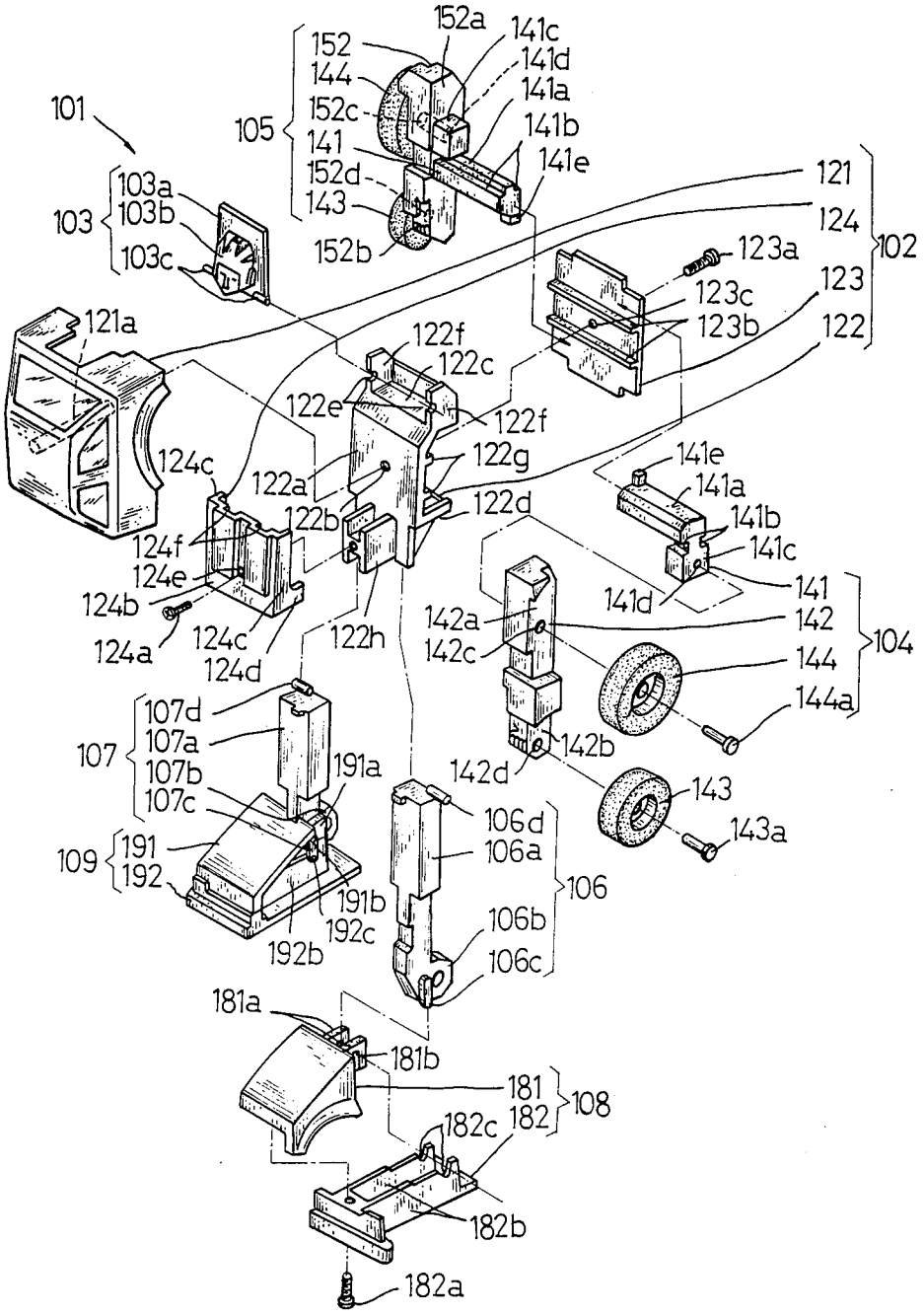
FIG. 10 is an exploded perspective view of the reversibly transformable toy block assembly shown in FIG. 8.

The block assembly 101 of the embodiment, as generally shown in FIGS. 8 and 9 and detailedly shown in FIG. 10, includes a trunk 102, a head 103 swingably attached to one end of the trunk 102, a pair of arms 104 and 105 slidably mounted on the both sides of the trunk 102, a pair of legs 106 and 107 slidably attached to the other end of the trunk 102, and a pair of feet 108 and 109 swingably connected to the lower ends of the legs 106 and 107.

Referring to FIG. 10, the trunk 102 includes a chest member 121 of a box-like shape forming a body of the toy vehicle formed when folding the block assembly; a trunk member 122 of a frame-like shape forming a chassis of the toy vehicle, which is attached to the chest member 121 by fitting a through-hole **122*b* formed at the central portion of a base plate 122*a* thereof on a mounting rod 121*a* provided on the central portion of the rear surface of the chest member 121; a cover plate 123 attached with respect to the rear surface of the chest member 121 by engaging a screw 123*a* with the end portion of the mounting rod 121*a*; and a leg mounting frame 124 attached to the lower portion of the front surface of the trunk member 122 by means of a screw 124*a*. The base plate 122*a* of the trunk member 122 is provided at the upper and lower portions of the front surface thereof with an upper frame 122*c* and a lower frame 122*d*, the upper frame 122*c* being provided on the both sides of the upper end thereof with stays 122*f* parallel with one another each having a recess 122*e* formed on the front portion thereof. The base plate 122*a* also has two projections 122*g* formed on the rear surface thereof between the upper and lower frames 122*c* and 122*d* so as to extend in parallel with each other in the lateral direction of the base plate. Further, the base plate 122*a* has an H-shaped leg mounting frame 122*h* provided at the lower portion of the front surface thereof. The cover plate 123 is formed on the front surface thereof with two parallel projections 123*b* of the substantially same shape as the projections 122*g* of the base plate 122*a* and at the central portion thereof with a throughhole 123*c*. The leg mounting frame 124 is provided on the both side portions of a base plate 124*b* thereof with a pair of frames 124*c* of a substantially L-shape and is formed at the central portion thereof with a through-hole 124*e*. The portion of the base plate 124*b* between the flanges 124*c* and 124*c* being formed on the rear side thereof with recesses 124***f* of a rectangular shape in parallel with each other.

The head 103 of the toy robot, as shown in FIG. 10, includes a base plate 103*a* also acting to form a number plate of the toy vehicle formed when folding the block assembly; a head member 103*b* fixedly mounted on the front surface of the base plate 103 which has a face resembling that of a robot; and a pair of pin members 103*c* provided on the both sides of the lower portion of the base plate 103*a* which are rotatably supported in the recesses 122*e* of the trunk to allow the head 103 to be swung thereabout.

Each of the arms 104 and 105 includes an upper arm member 141 slidably in the lateral direction between the trunk 122 and the cover member 123 and a lower arm member 142 (152) swingably connected to the lower end of the upper arm member 141, the lower arm member 142 (152) being provided with a pair of wheels 143 and 144 spaced from each other at a predetermined interval in the longitudinal direction thereof which are adapted to form one of the front wheels of the toy vehicle and one of the rear wheels thereof, respectively. The upper arm member 141 includes a rod-like base 141*a* of a substantially T-shape and a stay 141*c* rectangular in shape provided on the lower surface of the outer end portion of the base 141*a* so as to downwardly project therefrom, with grooves 141*b* being formed on the front and rear sides of the connecting portion between the base 141*a* and the stay 141*c*. The stay 141*c* is formed with a laterally extending through-hole 141*d* and the base 141*a* is provided at the upper end thereof opposite to the stay 141*c* with a stopper 141*e*. Each of the lower arm members 142 and 152 includes a rod-like base 142*a* (152*a*) and a hand 142*b* (152*b*) of a fist-like shape integrally connected to the lower end of the base 142*a* (152*a*). The lower arm member 142 (152) is formed with a pair of laterally extending through-holes 142*c* and 142*d* (152*c* and 152*d*) spaced from each other through which the wheels 142 and 143 are rotatably mounted on the outer side thereof by means of screws 143*a* and 144*a*, respectively.

Each of the legs 106 and 107 comprises a base member 106*a* (107*a*) of a square bar shape and a stay 106*b* (107*b*) provided at the lower end portion of the rear side of the base member. The stay 106*b* (107*b*) is provided on the inner and outer sides thereof with projections 106*c* and 107*c* of an ellipsoid shape. Also, the base member 106*a* (107*a*) has a pin-like stopper 106*d* (107*d*) provided on the outer side of the upper end portion thereof.

The feet 108 and 109 each comprise an upper foot member 181 (191) constructed to form one half of a hood of the toy vehicle divided into two halves and a lower foot member 182 (192) connected to the lower portion of the upper foot member 181 (191) by means of a screw 182*a*. The front end portion of each of the lower foot members 182 is constructed to form one half of a bumper of the toy vehicle. The upper foot member 181 (191) and the lower foot member 182 (192) are provided on the lower side thereof and the upper side thereof with a pair of stays 181*a* (191*a*) and a pair of stays 182*b* (192*b*), respectively. The respective pairs of stays 181*a* (191*a*) and 182*b* (192*b*) are formed with cutouts 181*b* (191*b*) and 182*c* (192*c*) into which the projections 106*c* (107*c*) is slidably and swingably inserted.

The manner of operating the reversibly transformable toy block assembly of the present embodiment will be hereinafter described in detail with reference to the drawings.

Briefly speaking, the toy block assembly 101 folded to form the toy vehicle as shown in FIG. 8 is subsequently unfolded in such a manner as shown in FIGS. 11A to 11D to form the toy robot as shown in FIG. 9.

Figure 11A:
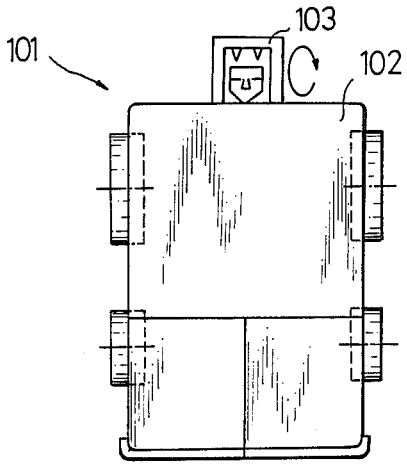
FIGS. 11A to 11D are diagrammatical views showing the steps of a process of transforming the toy block assembly of FIG. 8 from a toy vehicle into a toy robot.
Figure 11B:
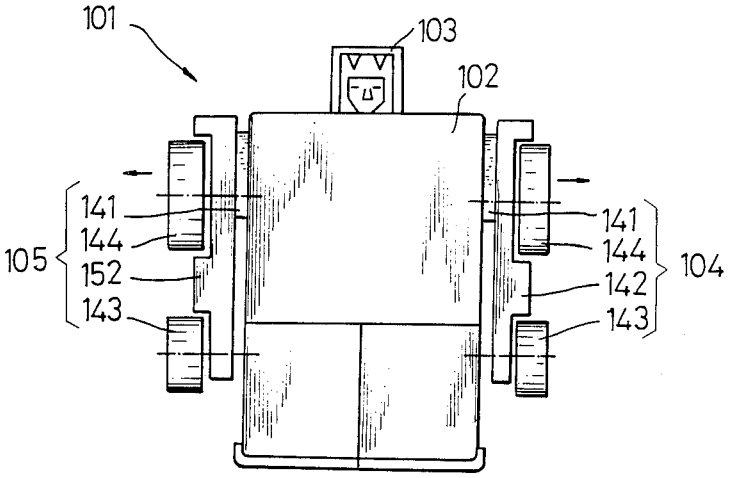
Figure 11C:
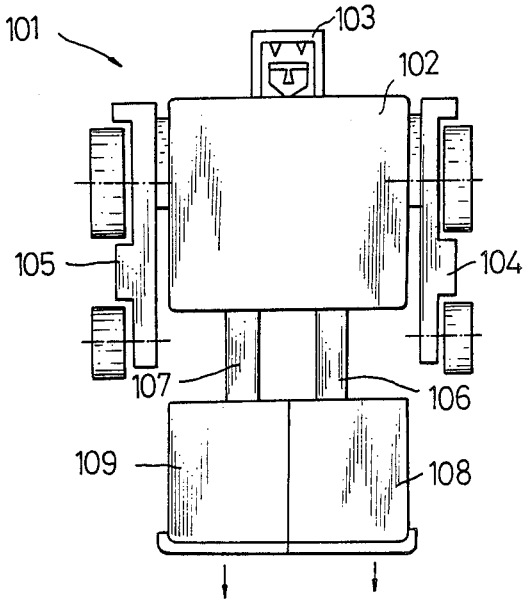
Figure 11D:
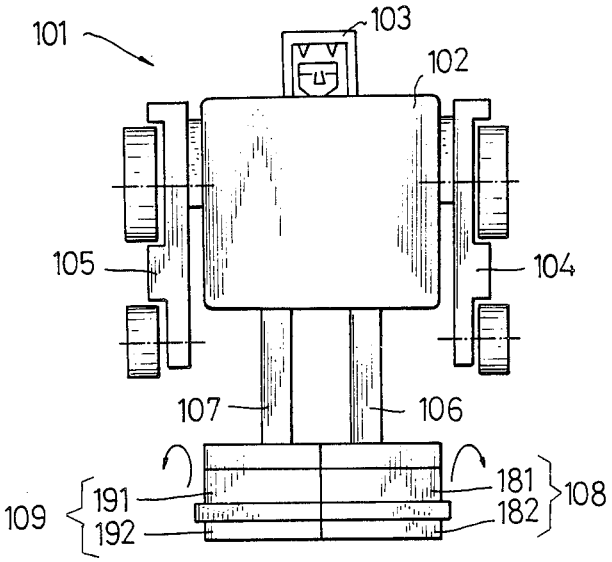

More particularly, firstly, the head 103 is upwardly swung to project above the trunk 102, as shown in FIG. 11A. Then, the pair of arms 104 and 105 are slidably moved outwardly from the trunk 102 in the lateral directions opposite to each other, as shown in FIG. 11B. Further, as shown in FIG. 11C, the legs 106 and 107 are slidably moved in the downward direction to downwardly project from the trunk 102. Finally, the feet 108 and 109 are forwardly swung by an angle of approximately 90 degree to face front. Thus, the block assembly 101 folded to be transformed into the toy vehicle is unfolded to form the toy robot as shown in FIG. 9.

The transformation of the toy block assembly from the so-formed toy robot into the toy vehicle as shown in FIG. 8 can be easily accomplished by operating the block assembly in a manner reverse to that as described above.

It will be noted that the reversibly transformable toy block assembly of the present invention may be constructed to allow a transformed toy vehicle to have an appearance resembling a truck, a bus or the like other than the vehicles as described hereinbefore. Also, the toy block assembly of the present invention may be provided with any suitable power means which allows the assembly to be moved. Furthermore, it is possible to construct the toy block assembly of the present invention in such a manner that it is provided with a gun or the like.

In view of the foregoing, it will be readily understood that the toy block assembly of the present invention has an advantage of accomplishing unexpected reversible transformation between the toy vehicle and the toy robot to allow children's interest to be redoubled. In addition, the toy block assembly of the present invention is capable of effectively preventing the constituent elements from being disconnected or lost therefrom, because the elements are foldably interconnected with one another. Further, the present invention can provide children with a high level of play because it carries out a unique transformation. Furthermore, the present invention has further advantages such as simplification in construction, ease to be manufactured and low manufacturing costs.

It will thus be seen that the objects of the present invention set forth above, among those other objects. made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A reversibly transformable toy block assembly, comprising:

a frame means for supporting said toy block assembly;

a pair of first movable elements mounted on both sides of said frame means so as to be shiftable between a first position and a second position;

a second movable element mounted on said frame means so as to be shiftable between a third position and a fourth position;

a pair of third movable elements slidably mounted on said frame means so as to be slidable between a fifth position and a sixth position; and a pair of fourth movable elements each attached to the end portion of each said third movable elements so as to be movable between a seventh position and an eighth position; wherein said toy block assembly forms a toy vehicle when said toy first, second, third and fourth movable elements are respectively in the first, third, fifth and seventh positions and said toy block assembly forms a toy humanoid robot different in appearance from said toy vehicle when the first to fourth movable elements are respectively in the second, fourth, sixth and eighth positions, when said toy block assembly is transformed into said toy robot, said frame means forms a trunk of said toy robot and said first to fourth movable elements respectively form arms, a head, legs and feet of said toy robot, each of the elements being permanently connected together as a unitary toy assembly.

2. A reversibly transformable toy block assembly as defined in claim 1, wherein said first movable elements are pivotably connected with respect to said both sides of said frame means.

3. A reversibly transformable toy block assembly as defined in claim 1, wherein said first movable elements are slidably mounted with respect to said both sides of said frame means.

4. A reversibly transformable toy block assembly as defined in claim 1, wherein said toy block assembly is transformed into said toy vehicle having a housing, a pair of front wheels and a pair of rear wheels, said toy vehicle further including two rotating members rotatably mounted at a predetermined interval on each of said first movable elements, said rotating members of said first movable elements forming said pair of front wheels and said pair of rear wheels.

5. A reconfigurable toy vehicle comprising:

a first housing member configured in a first position to simulate a front portion of a vehicle, including a, roof member and a front wheel supporting member, the front wheel supporting member being extendable away from the roof member; and a second housing member configured in a first position to simulate a rear portion of a vehicle, the respective members are permanently connected and relatively movable apart from each other to assume a second position having a robotic humanoid form, a portion of one of the first and second housing members is pivotally movable to provide a robotic humanoid head while a portion of the other housing member is movable to provide robotic humanoid feet, the first housing member having its roof member forming a part of a robotic humanoid body with the front wheel supporting member extended away from the roof member to form the robotic humanoid feet.

6. The invention of claim 5 wherein the respective housing members form in a first position a sports car configuration.

7. The invention of claim 5 wherein the second housing member further includes a first and second articulated side member supporting respectively a wheel for contacting a support surface in a first position and capable of being extended in the second position to form respective robotic humanoid arm appendages.

8. The invention of claim 7 wherein the first and second articulated side members are folded beneath the toy vehicle in the vehicle mode of operation.

9. A reconfigurable toy vehicle comprising:

a first housing member configured in a first position to simulate a front portion of a vehicle, including a roof member and a pair of front wheel supporting members simulating the motor hood of a car, the front wheel supporting members are extendable from a vehicle configuration and pivotable into robot feet configurations; and a second housing member configured in a first position to simulate a rear portion of a vehicle, the respective housing members are permanently connected together but are further relatively movable apart from each other to assume a second position having a robotic humanoid form, a portion of one of the first and second housing members is pivotally movable to provide a robotic humanoid head; the second housing member further includes a first and second articulated side member supporting respectively a wheel for contacting a support surface in a first position and capable of being extended in the second position to form respective robotic humanoid arm appendages, the first position providing the major portion of the articulated side members in a parallel stored position extending across the bottom surface of the vehicle configuration.

10. A toy block assembly reversibly transformable between a toy vehicle formed by folding said block assembly and a toy humanoid robot formed by unfolding said block assembly, comprising, when said toy block assembly is in the shape of said toy robot:

front and rear wheels;

a roof member forming a trunk of said toy robot;

a pair of first members movably attached to one end of said trunk forming member so as to form legs of said robot when extended from a vehicle position;

a member foldably attached to the other end of said trunk forming member, which forms a head of said toy robot;

a pair of articulated members foldably mounted on both sides of said trunk forming member, which forms arms of said toy robot when extended from a vehicle position and respective supports for the rear wheels; and hood members pivotally attached to said leg forming members, which form feet of said toy robot, said members, as a whole, forming said toy vehicle when said head forming member, said foot forming members and said arm forming members are folded and pivoted and said leg forming members are contracted.

11. A toy block assembly reversibly transformable between a toy vehicle formed by folding said block assembly and a toy robot formed by unfolding said block assembly, comprising;

a first member forming the middle and rear portions of said toy vehicle when folded and said middle portion forming a trunk of said toy robot when unfolded;

a second member rotatably attached to one end of said first member, said second member forming a rear surface of said toy vehicle and a head of said toy robot;

a pair of third members stretchably mounted on both sides of said first member, said third members forming a lower side surface and front and rear wheels of said toy vehicle and a pair of arms of said toy robot;

a pair of fourth members stretchably attached to the other end of said first member, said fourth members forming a pair of legs of said toy robot which are receivable in said trunk; and a fifth member rotatably attached to one end of each of said fourth members, said fifth members forming the front portion of said toy vehicle and a pair of feet of said toy robot.

12. A reversibly transformable toy block assembly capable of forming a toy vehicle and a toy robot comprising:

a frame means;

a pair of first movable elements mounted on both sides of said frame means so as to be shiftable between a first position and a second position;

a second movable element mounted on said frame means so as to be shiftable between a third position and a fourth position;

a pair of third movable elements slidably mounted on said frame means so as to be slidable between a fifth position and a sixth position; and a pair of fourth movable elements each attached to the end portion of each said third movable elements so as to be shiftable between a seventh position and an eighth position; wherein said toy block assembly forms a toy vehicle when said first, second, third and fourth movable elements are respectively in the first, third, fifth and seventh positions and said toy block assembly forms a toy robot when the first to fourth movable elements are respectively in the second, fourth, sixth and eighth positions, when said toy block assembly is transformed into said toy robot, said frame means forms a trunk of said toy robot and said first to fourth movable elements respectively form arms, a head, legs and feet of said toy robot, said feet of said toy robot are separated from each other to from a pair, said fourth movable elements comprising a pair of movable parts pivotally connected to the respective end portions of said third movable elements, said movable parts forming said pair of feet of said toy robot, wherein said toy block assembly is transformed into said toy vehicle having a housing, a pair of front wheels and a pair of rear wheels, said toy vehicle including a rotating member rotatably mounted with respect to each of said pair of first movable elements and said pair of movable parts which form said fourth elements, said rotating member of said first movable elements forming said pair of rear wheels and said rotating member of said movable parts of said fourth elements forming said pair of front wheels.

* * * * *